US007121649B2

(12) United States Patent
Chikamoto

(10) Patent No.: US 7,121,649 B2
(45) Date of Patent: Oct. 17, 2006

(54) INK-JET HEAD AND RESERVOIR UNIT INCLUDED IN INK-JET HEAD

(75) Inventor: Tadanobu Chikamoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 233 days.

(21) Appl. No.: 10/913,476

(22) Filed: Aug. 9, 2004

(65) Prior Publication Data

US 2005/0036005 A1 Feb. 17, 2005

(30) Foreign Application Priority Data

Aug. 14, 2003 (JP) ..... 2003-293432

(51) Int. Cl.
*B41J 2/05* (2006.01)

(52) U.S. Cl. ..... 347/65; 347/71; 347/40

(58) Field of Classification Search ..... 347/20, 347/40, 54, 63, 65, 67–68, 70, 71, 84–86
See application file for complete search history.

(56) References Cited

U.S. PATENT DOCUMENTS 4,611,219 A * 9/1986 Sugitani et al. ..... 347/40
6,979,077 B1 * 12/2005 Sakaida ..... 347/68
2003/0090540 A1 5/2003 Shimizu ..... 349/49

FOREIGN PATENT DOCUMENTS

| | | |
|---|---|---|
| EP | 0 867 290 A2 | 9/1998 |
| EP | 1 316 425 A2 | 6/2003 |
| EP | 1 403 063 A1 | 3/2004 |
| JP | A 02-052745 | 2/1990 |
| JP | A 06-255101 | 9/1994 |
| JP | A 10-138485 | 5/1998 |

* cited by examiner

*Primary Examiner*—Juanita D. Stephens
(74) *Attorney, Agent, or Firm*—Oliff & Berridge, PLC

(57) ABSTRACT

An ink-jet head comprises a passage unit and a reservoir unit. The passage unit includes a common ink chamber that extends in one direction. The reservoir unit is fixed to the passage unit, and includes an ink reservoir that stores ink and that extends in the one direction. In the reservoir unit, formed are an introduction passage extending from an ink introduction port to the ink reservoir, and a discharge passage extending from the ink reservoir to ink discharge ports. The introduction passage and the discharge passage include an inflow port and an outflow port, respectively. Both the inflow port and the outflow port face the ink reservoir. The inflow port is disposed such that at least one outflow port can exist on either side of the inflow port with respect to the one direction.

14 Claims, 9 Drawing Sheets

INK-JET HEAD AND RESERVOIR UNIT INCLUDED IN INK-JET HEAD

BACKGROUND OF THE INVENTION

1. Field of the Invention

The present invention relates to an ink-jet head that ejects ink onto a record medium and thereby conducts a recording and to a reservoir unit included in an ink-jet head.

2. Description of Related Art

An ink-jet head is applicable to a recording apparatus such as printers and facsimile machines, etc. The ink-jet head comprises a plurality of nozzles, pressure chambers that communicate with the respective nozzles, an actuator that selectively applies ejection energy to ink contained in the pressure chambers, and the like. Ink is supplied from an ink supply source such as an ink tank, and then distributed among the respective pressure chambers. Upon driving of the actuator, the ink is ejected from the nozzles communicating with the pressure chambers. According to one of known technique, this type of ink-jet head comprises, for the purpose of stable ink supply to the pressure chambers, a reservoir that stores ink having supplied from the ink supply source and supplies the ink directly to the respective pressure chambers (see Japanese Patent No. 2992756).

In addition, the ink-jet head sometimes employs a construction in which the pressure chambers are arranged at a high density in order to meet demands for high-resolution printing and high-speed printing.

SUMMARY OF THE INVENTION

Particularly when the ink-jet head employs not only the reservoir but also the foregoing construction, a passage toward the pressure chamber becomes complicated, and therefore it becomes hard to supply ink from the reservoir directly to the respective pressure chambers.

An object of the present invention is to provide an ink-jet head capable of, even when the pressure chambers are arranged at a high density, smoothly supplying ink to respective pressure chambers using a reservoir, and to provide a reservoir unit included in an ink-jet head.

According to an aspect of the present invention, there is provided an ink-jet head comprising a passage unit and a reservoir unit. The passage unit includes a common ink-chamber extending in one direction and a plurality of individual ink passages each extending from the common ink chamber through a pressure chamber to a nozzle. The reservoir unit is fixed to the passage unit and includes an ink reservoir that stores ink. The ink reservoir extends in the one direction and has a larger capacity than that of the common ink chamber. The reservoir unit includes: an ink introduction port into which ink is introduced; an introduction passage that extends from the ink introduction port to the ink reservoir and includes an inflow port facing the ink reservoir; a plurality of ink discharge ports through which ink is discharged into the common ink chamber; and a plurality of discharge passages that extend from the ink reservoir to the ink discharge ports and include a plurality of outflow ports facing the ink reservoir. The inflow port is disposed such that at least one outflow port can exist on either side of the inflow port with respect to the one direction.

According to another aspect of the present invention, there is provided a reservoir unit fixed to a passage unit in an ink-jet head. The passage unit has a common ink chamber extending in one direction and a plurality of individual ink passages each extending from the common ink chamber through a pressure chamber to a nozzle. The reservoir unit comprises an ink reservoir for storing ink, an inflow port, and a plurality of outflow ports. The ink reservoir extends in the one direction, has a larger capacity than that of the common ink chamber, and is in fluid communication with the common ink chamber. The ink reservoir is in fluid communication with an outside of the reservoir and the common ink chamber though the inflow port and the plurality of outflow ports, respectively.

When, differently from the aforementioned configurations, the inflow port is disposed such that no outflow port can exist on one side thereof (e.g., disposed at a position corresponding to one end of the ink reservoir), distances between the inflow port and the respective outflow ports differ from one another to a larger extent. In particular, a distance between the inflow port and the outflow port nearest to the inflow port becomes largely different from a distance between the inflow port and the outflow port most remote from the inflow port. In this case, prior to ink reaching the outflow ports remote from the inflow port, ink that has passed through the outflow ports nearer to the inflow port and then through the corresponding ink discharge ports to thereby already reach the common ink chamber can disadvantageously flow back through the outflow ports remote from the inflow port into the ink reservoir again. Such an ink backflow can cause air to stay within the ink reservoir, and therefore ink cannot possibly be supplied to some of the pressure chambers.

On the other hand, since either of the aforementioned configurations can relatively reduce differences in distance between the inflow port and the respective outflow ports, the above-described backflow can be prevented. As a result, a problem of air stay within the ink reservoir and the like can be relieved, so that ink can smoothly be supplied to the respective pressure chambers.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

In the following, a certain preferred embodiment of the present invention will be described with reference to the accompanying drawings.

Figure 1:
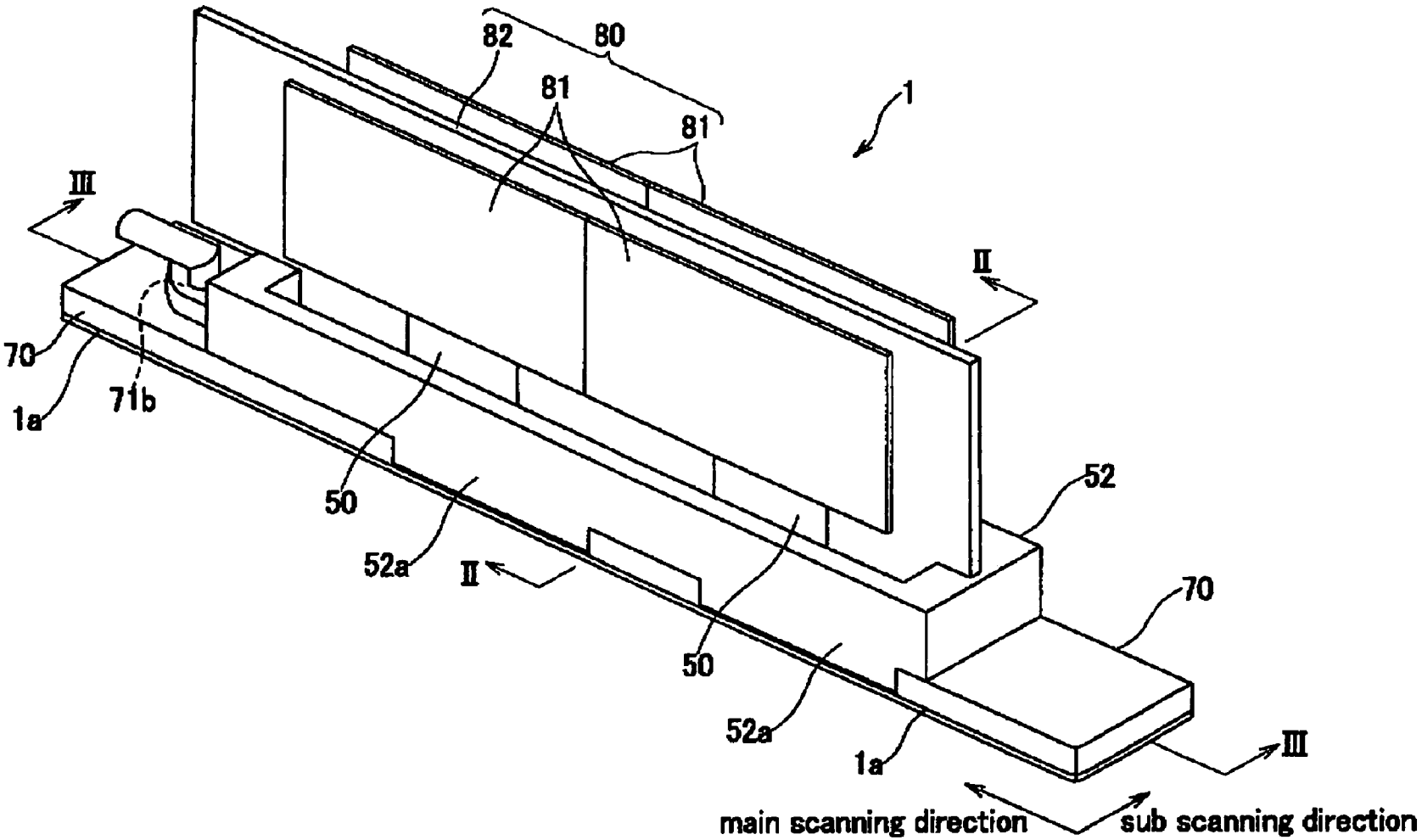
FIG. 1 is a perspective view of an ink-jet head according to an embodiment of the present invention.
Figure 2:
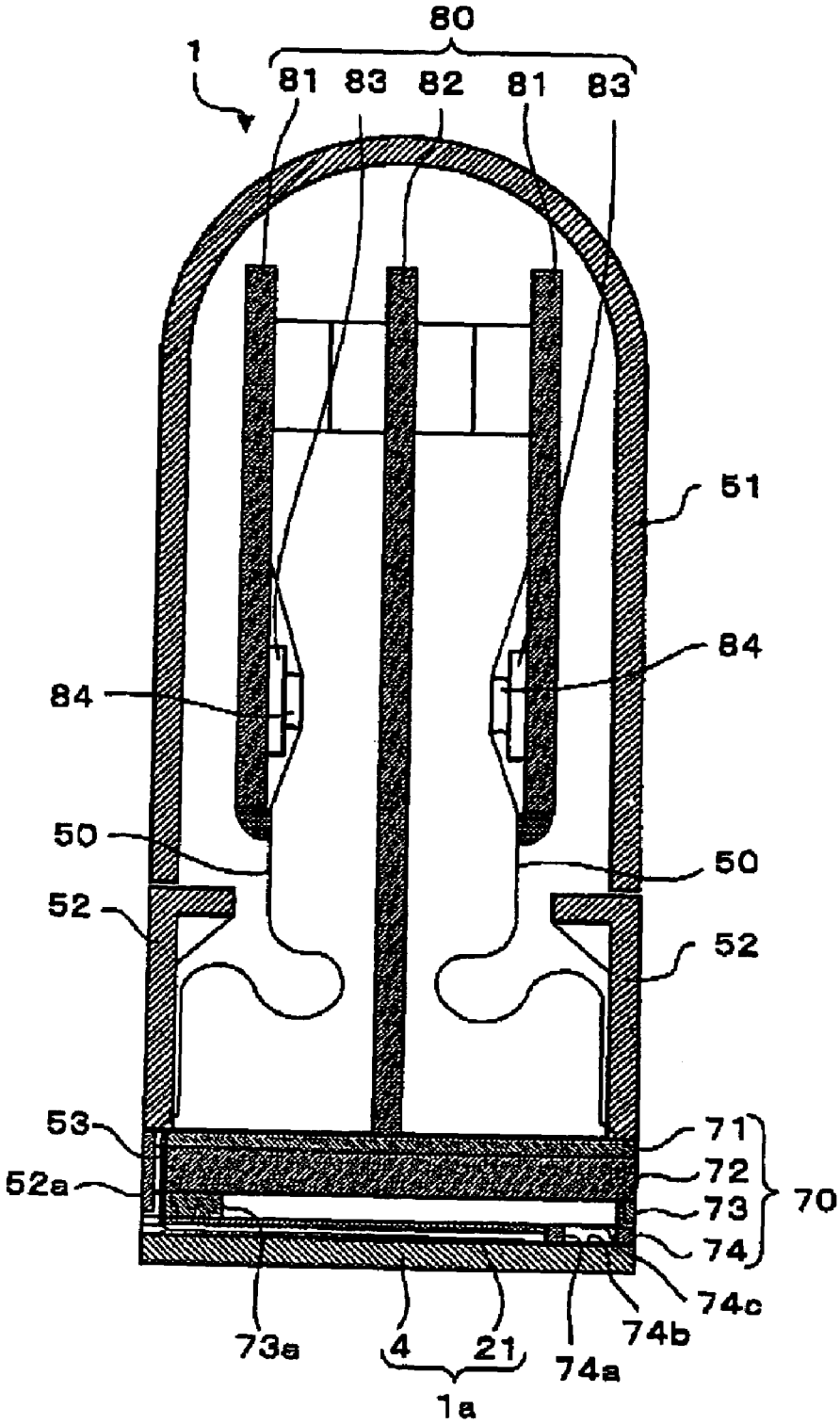
FIG. 2 is a sectional view taken along a line II—II of FIG. 1.

As illustrated in FIG. 1, an ink-jet head 1 according to an embodiment of the present invention has a shape elongated in a main scanning direction, and comprises, from one nearest to its bottom, a head main body 1*a*, a reservoir unit 70 (not shown in FIG. 1; see FIG. 2), and a control unit 80 that controls driving of the head main body 1*a*. As illustrated in FIG. 2, an upper covering 51 and a lower covering 52 are provided for the purpose of protecting against ink an upper part of the head including the control unit 80 and a lower part thereof including the reservoir unit 70, respectively. An illustration of the upper covering 51 is omitted from FIG. 1 so that the control unit 80 may be exposed into a visible state.

Here, referring to FIGS. 1 and 2, a construction of the control unit 80 will be described.

The control unit includes a main substrate 82, two sub substrates 81 disposed on both sides of the main substrate 82, and driver ICs 83 (see FIG. 2) each fixed to a side face of each sub substrate 81 confronting the main substrate 82.

The main substrate 82, whose plane extends in a vertical direction and in the main scanning direction, has a rectangular shape elongated in the main scanning direction and is fixed onto the reservoir unit 70 in a perpendicular manner. The two sub substrates 81 are laid in parallel with the main substrate 82, and disposed on both sides of the main substrate 82 to be equidistantly spaced apart therefrom. The two sub substrates 81 are electrically connected with the main substrate 82. The driver ICs 83 (see FIG. 2) generate signals for driving the actuator unit 21 that is included in the head main body 1*a*. A heat sink 84 is fixed to a face of each driver IC 83 confronting the main substrate 82.

The sub substrate 81 and the driver IC 83 fixed to each other make a pair, and each pair is electrically connected with an FPC 50 acting as a power supply member. The FPC 50 is, at its one end, connected with the actuator unit 21, too, so that the FPC 50 transmits to the driver IC 83 a signal outputted from the sub substrate 81, and feeds to the actuator unit 21 a drive signal outputted from the driver IC 83.

The upper covering 51 and the lower covering 52 will then be described.

As illustrated in FIG. 2, the upper covering 51 is a housing with an arched ceiling. The upper covering 51 covers the sub substrates 81 and an upper portion of the rain substrate 82.

The lower covering 52 is a substantially rectangular-cylindrical housing that is opened out in its upper side and lower side. The lower covering 52 covers portions of the FPCs 50 which are extended out of a passage unit 4 included in the head main body 1*a*. Within a space covered by the lower covering 52, the FPCs 50 are laid in a loose manner in order to avoid stress put thereon.

At a top of the lower covering 52, ends of its sidewalls are bent at approximately 90 degrees to thereby form a horizontal level. On a joint portion of this horizontal level with each sidewall, placed is a lower open end of the upper covering 51.

Each sidewall of the lower covering 52 (only one of which is visible in FIG. 1) has, at its bottom end, two protrusions 52*a* protruding downward. The two protrusions 52*a* are disposed side by side along a lengthwise direction of the sidewall. Each protrusion 52*a* covers a portion of the FPC 50 disposed within a groove 53 of the reservoir unit 70, and at the same time the protrusions 52*a* are themselves received within the grooves 53 of the reservoir unit 70, as illustrated in FIG. 2. A tip end of each protrusion 52*a* confronts the passage unit 4 included in the head main body 1*a* with a certain clearance formed therebetween for absorbing manufacture errors. A silicone resin, etc., is packed into this clearance which is thereby sealed up. Except for the protrusions, 52*a*, the bottom ends of the sidewalls of the lower covering 52 are disposed on the reservoir unit 70.

As illustrated in FIG. 2, one end portion of the FPC 50 connected with the actuator unit 20 horizontally extends in a plane of the passage unit 4. Each FPC 50 is, while forming a bent portion in its midway, upwardly extended out through the groove 53 of the reservoir unit 70, so that the other end of the FPC 50 can be connected with the corresponding pair of sub substrate 81 and driver IC 83 of the control unit 80.

Both of the lower covering 52 and the upper covering 51 have substantially the same width as that of the passage unit 4.

Figure 3:
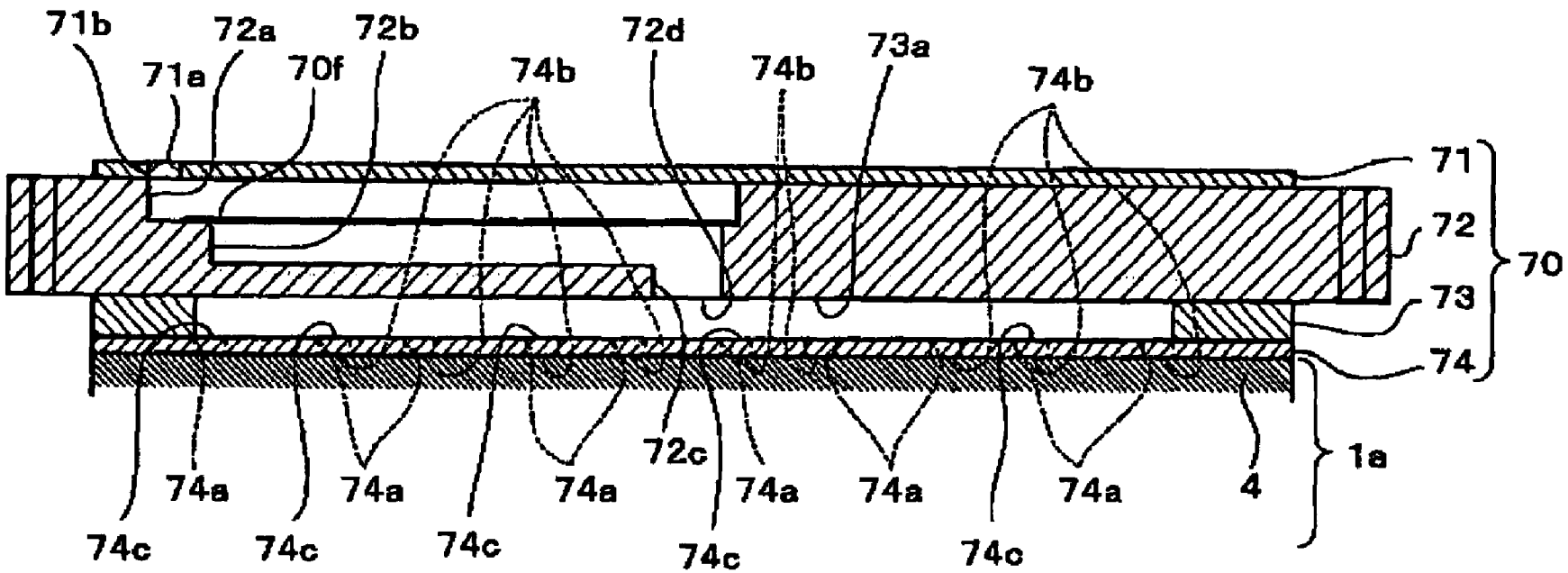
FIG. 3 is a sectional view of a reservoir unit taken along a line III—III of FIG. 1.

Then, referring to FIGS. 2, 3, and 4, a description will be given to a construction of the reservoir unit 70. For the purpose of explanatory convenience, FIG. 3 is drawn on an enlarged scale in the vertical direction.

The reservoir unit 70 has a layered structure of four plates, i.e., an upper plate 71, a filter plate 72, a reservoir plate 73, and an under plate 74. Each of the four plates 71 to 74 has a substantially rectangular plan view shape elongated in the main scanning direction (see FIG. 1).

Herein, a direction parallel with the elongated direction of the four plates 71 to 74 is referred to as a lengthwise direction of the four plates 71 to 74, a direction perpendicular to the lengthwise direction in a plan is referred to a widthwise direction of the four plates 71 to 74, and a direction perpendicular to both the lengthwise and widthwise directions is referred to as a thickness direction of the four plates 71 to 74.

Figure 4:
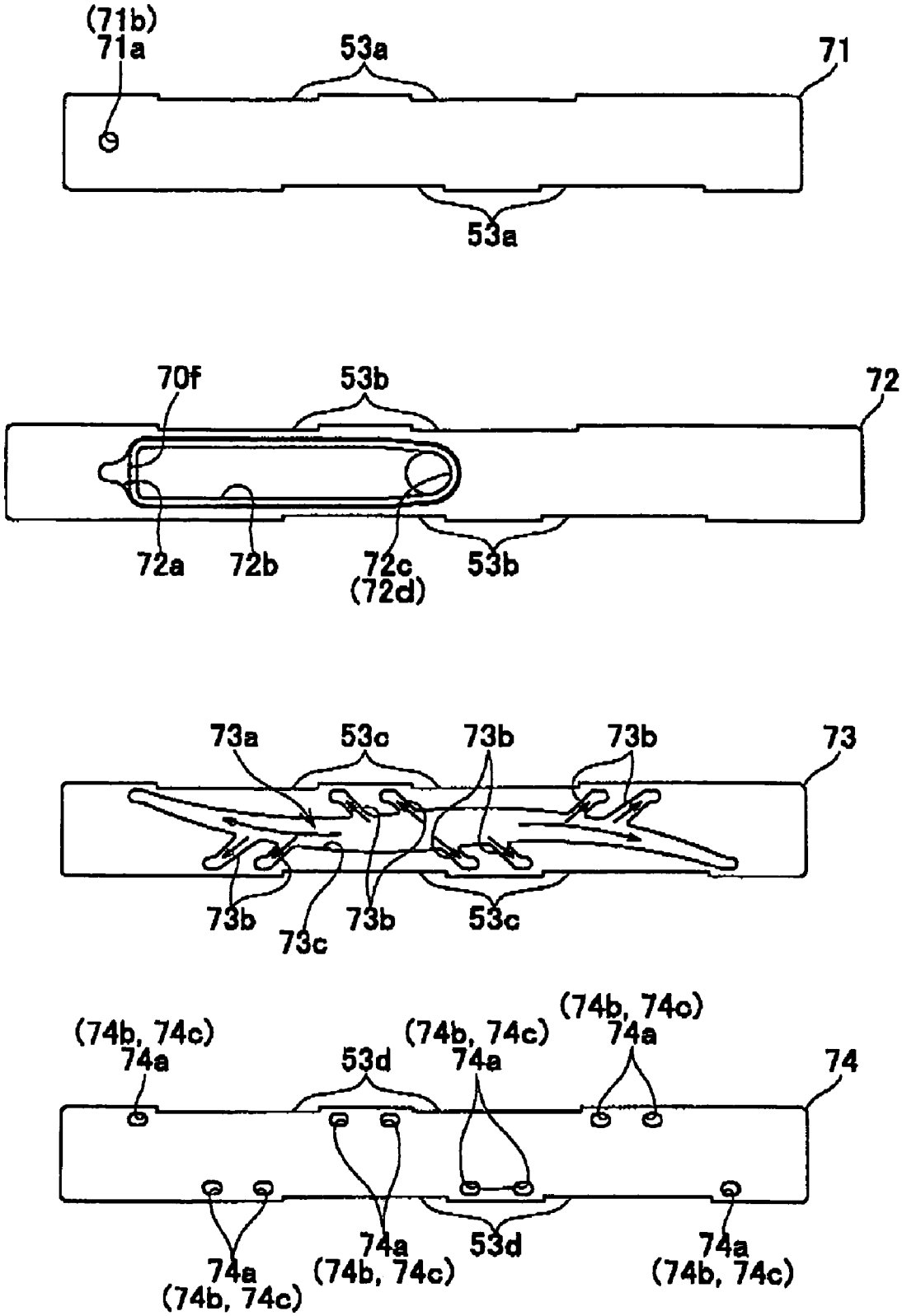
FIG. 4 is an exploded plan view of the reservoir unit illustrated in FIG. 3.

As illustrated in FIG. 4, the four plates 71, 72, 73, and 74 have, at their both widthwise ends, a total of four rectangular notches 53*a*, 53*b*, 53*c*, and 53*d*, respectively. At each widthwise end of each plate, two notches are formed side by side along a lengthwise direction of the plate. The four notches are arranged in a staggered pattern. These notches 53*a* to 53*d* are aligned with one another in the vertical direction to thereby form a groove 53 (see FIG. 2) that has a rectangular shape in a plan view and penetrates through the reservoir unit 70 in the vertical direction. Thus, two grooves 53 are formed on each side face of the reservoir unit 70 relative to its widthwise direction, that is, a total of four grooves 53 are formed on its side faces. The four grooves 53 are arranged apart from one another in a staggered pattern along the length of the reservoir unit.

At one lengthwise end of the upper plate 71, a substantially circular hole 71*a* is formed in the middle of the width by means of etching, etc. The hole 71*a* penetrates through the upper plate 71 in its thickness direction, so that an ink introduction port 71*b* can be formed in a top face of the upper plate 71.

In the filter plate 72, as illustrated in FIG. 3, formed is a first depression 72*a* having a depth of approximately one third of a thickness of the filter plate 72. The first depression 72*a* is, in a plan view, elongated from a portion corresponding to the hole 71*a* to a center of the filter plate 72. At the portion corresponding to the hole 71*a*, the first depression 72*a* is shaped in conformity with a shape of the hole 71*a* in a plan view. At the center of the filter plate 72, the first depression 72*a* is shaped in conformity with a shape of a hole 72*c* in a plan view (see FIG. 4).

In the filter plate 72, further, a second depression 72*b* is formed under the first depression 72*a*, as illustrated in FIG. 3. A depth of the second depression 72*b* is approximately one third of the thickness of the filter plate 72. The second depression 72*b* and the first depression 72*a* has substantially the same shape, and the second depression 72*b* is somewhat smaller than the first depression 72*a* in a plan view.

A step is formed at a boundary between the first depression 72*a* and the second depression 72*b*. On this step, disposed is a filter 70*f* that removes dust and dirt contained in ink. The filter 70*f* has substantially the same shape as that of an area of the first depression 72*a* except for the portion corresponding to the hole 71*a* in a plan view. The filter 70*f* is slightly smaller than this area in a plan view.

In the filter plate 72, still further, a substantially circular hole 72*c* is formed under the second depression 72*b*, so that an inflow port 72*d* can be formed in a bottom face of the filter plate 72. The inflow port 72*d* is disposed at a position corresponding to the center of the filter plate 72 and also corresponding in a plan view to a center of a later-described ink reservoir 73*a* with respect to an extending direction of the ink reservoir 73*a* (hereinafter referred to simply as "a center of the ink reservoir 73*a*"). The inflow port 72*d* confronts the ink reservoir 73*a*, and at the same time confronts a later-described main passage 73*c* of the ink reservoir 73*a*.

An ink reservoir 73*a* that stores ink is formed in the reservoir plate 73 by press working, etc. The ink reservoir 73*a* penetrates through the reservoir plate 73 in its thickness direction. In a plan view, as illustrated in FIG. 4, the ink reservoir 73*a* curvedly extends in the main scanning direction while tapering toward its lengthwise ends, and the ink reservoir 73*a* is point-symmetrical with respect to a center thereof.

The ink reservoir 73*a* is made up of a main passage 73*c* that extends in the main scanning direction, and branch passages 73*b* that branch from the main passage 73*c*. A width of each branch passage 73*b* is narrower than that of the main passage 73*c*. Among the branch passages 73*b*, every two branch passages 73*b* extending in the same direction make a pair. Two pairs of branch passages 73*b* running in different directions from each other are extended out from each widthwise end of the main passage 73*c*. The two pairs of branch passages 73*b* are spaced apart from each other in the extending direction of the main passage 73*c*. The four pairs of branch passages 73*b* are disposed in a staggered pattern.

In the ink reservoir 73*a*, both lengthwise ends of the main passage 73*c* and ends of the respective branch passages 73*b* correspond to portions of the under plate 74 where holes 74*a* are formed.

Ten holes 74*a* in total are formed in the under plate 74 by etching, etc. Each of the holes 74*a* has substantially circular shape and penetrates through the under plate 74 in its thickness direction, so that ink outflow ports 74*c* can be formed in a top face of the under plate 74 and ink discharge ports 74*b* can be formed in a bottom face thereof. The ink outflow ports 74*c* confront the ink reservoir 73*a*, and at the same time confront the respective branch passages 73*b* of the ink reservoir 73*a*. The ink discharge ports 74*b* confronts later-described receiving ports 5*b* of the passage unit 4. Ink is discharged from the ink discharge ports 74*b* toward manifold channels 5.

Five holes 74*a* are disposed near each widthwise end of the under plate 74 in a staggered pattern along the lengthwise direction, and the holes 74*a* are disposed point-symmetrically with respect to the center of the ink reservoir 73*a*. More specifically, along one widthwise end of the under plate 74, one hole 74*a*, two holes 74*a*, and two holes 74*a* are spacedly disposed in this order from one side in the lengthwise direction. Along the other widthwise end of the under plate 74, one hole 74*a*, two holes 74*a*, and two holes 74*a* are spacedly disposed in this order from the other side in the lengthwise direction. The holes 74*a* are so disposed as to keep away from the notches 53*d*. In other words, each hole 74*a* is disposed between two neighboring notches 53*d*.

When the four plates 71 to 74 are positioned relative to one another and put in layers, an ink passage as shown in FIGS. 3 and 4 is formed within the reservoir unit 70.

Herein, a passage extending from the ink introduction port. 71*b* to the ink reservoir 73*a*, that is, a passage formed within the hole 71*a*, the first depression 72*a*, the second depression 72*b*, and the hole 72*c* is referred to as an introduction passage, and a passage extending from the ink reservoir 73*a* to each ink discharge port 74*b*, that is, a passage formed within the hole 74*c* is referred to as a discharge passage. The introduction passage has, at its downstream end, the inflow port 72*d*. Each discharge passage has, at its upstream end, the outflow port 74*c*. Both the inflow port 72*d* and the outflow ports 74*c* face the ink reservoir 73*a*. The inflow port 72*d* is disposed such that there can exist five outflow ports 74*c* on either side of the inflow port 72*d* with respect to the extending direction of the ink reservoir 73*a* (see FIG. 4). Each discharge passage is a cylindrical passage formed within the hole 74*a* to extend in the vertical direction. The respective outflow ports 74*c* and the respective ink discharge ports 74*b* coincide with each other in a plan view.

Ink contained within an ink supply source (not illustrated) such as an ink tank is introduced, via, e.g., a tube (not illustrated) inserted into the hole 71*a*, into the ink introduction port 71*b*, and then supplied through the introduction passage to the ink reservoir 73*a*. In the introduction passage, ink firstly flows into one end of the first depression 72*a*, and spreads within the first depression 72*a* in a horizontal direction. The ink passes through the filter 70*f* for removing dust and dirt therefrom, and then reaches the second depression 72*b*. Thereafter, the ink passes through the hole 72*c*, and flows from the inflow port 72*d* into the center of the ink reservoir 73*a*, where the ink is temporarily stored. At this time, as shown by arrows in FIG. 4, the ink having flown into the center of the ink reservoir 73*a* spreads from a center of the main passage 73*c* toward the ends of the respective branch passages 73*b* as well as toward the ends of the ink reservoir 73*a* in the extending direction thereof. Then, the ink passes, from the respective outflow ports 74*c*, through the discharge passages formed within the respective holes 74*a*, to be supplied into the passage unit 4 via the ink discharge ports 74*b* and the ink receiving ports 5*b* (see FIG. 5).

As illustrated in FIG. 2, a bottom of the under plate 74 has been processed by half etching, etc., so that only a periphery of each ink discharge port 74*b* can protrudes downward. Since the ink discharge ports 74*b* are formed in the under plate 74 in the staggered pattern (see FIG. 4) as mentioned above, protrusions formed on the bottom of the under plate 74 are also in a staggered pattern. The reservoir unit 70 is fixed to the top face of the passage unit 4 such that it can be in contact with the passage unit 4 only at the protrusions of the under plate 74 formed around the ink discharge ports 74*b* and its portions other than the protrusions can be spaced apart from the passage unit 4.

As illustrated in FIG. 2, except for the grooves 53, widthwise ends of the reservoir unit 70 are aligned with widthwise ends of the passage unit 4 in the vertical direction. In addition, a total width of the reservoir unit 70 including the lower covering 52 is substantially the same as the width of the passage unit 4.

Then, a description will be given to a construction of the head main body 1*a* with reference to FIGS. 2, 5, 6, 7, 8, 9A, and 9B. In FIG. 6, for the purpose of explanatory convenience, pressure chambers 10 and apertures 12 are illustrated with solid lines though they locate below the actuator units 21 and therefore should be illustrated with broken lines.

Figure 5:
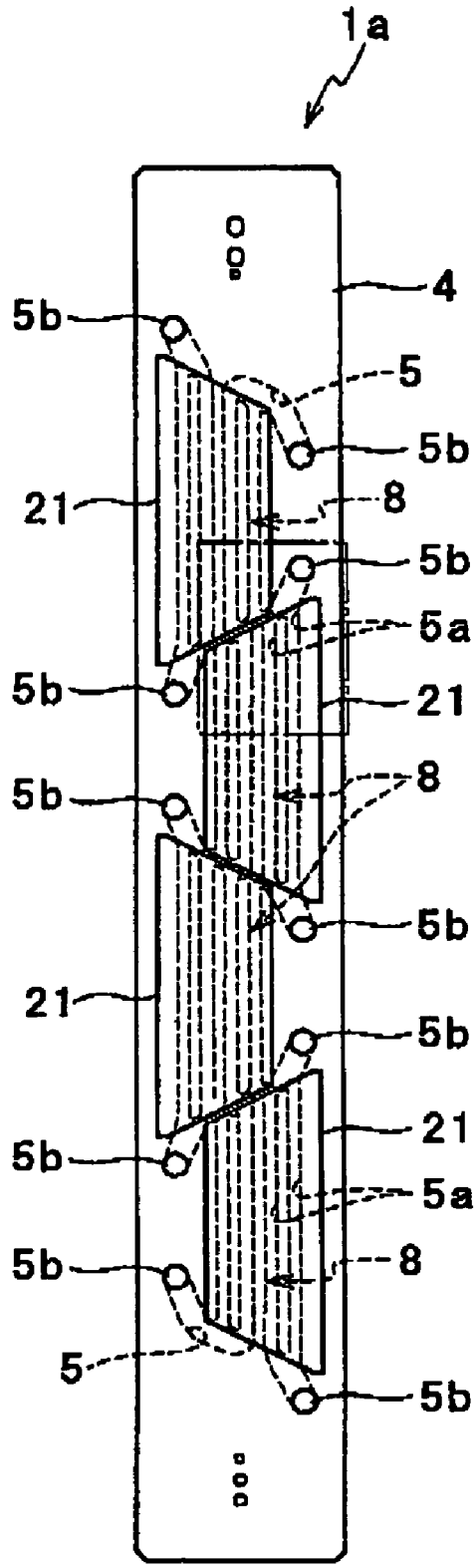
FIG. 5 is a plan view of a head main body illustrated in FIG. 1.
Figure 6:
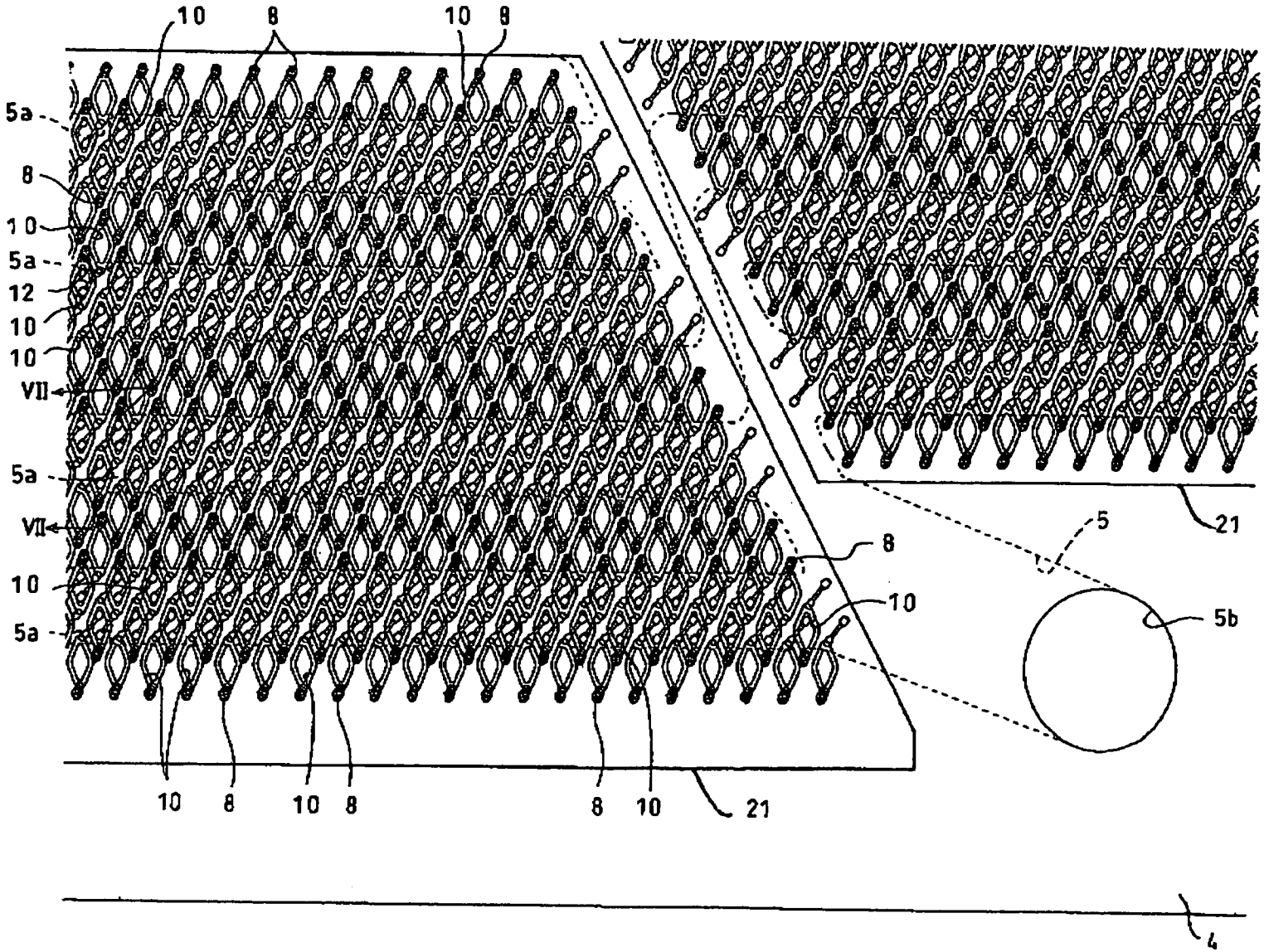
FIG. 6 is an enlarged view of a region enclosed with an alternate long and short dash line in FIG. 5.

As illustrated in FIGS. 2 and 5, the head main body 1*a* includes the substantially rectangular parallelepiped passage unit 4, and four actuator units 21 fixed to the top face of the passage unit 4. The plan view shape of the passage unit 4 has substantially the same shape and the same size as those of a plane of the reservoir unit 70 except for the grooves 53. The actuator units 21 serve to selectively apply ejection energy to ink contained in the pressure chambers that are formed in the passage unit 4. The actuator units 21 are fixed on such areas of the top face of the passage unit 4 as to spacedly confront the reservoir unit 70. The actuator units 21 are out of contact with the reservoir unit 70 and spaced apart therefrom.

As illustrated in FIG. 5, the four actuator units 21 each having a trapezoidal shape in a plan view are arranged on the top face of the passage unit 4 in a staggered pattern. The actuator units 21 are disposed such that parallel opposed sides of each actuator unit 21 may extend along a lengthwise direction, that is, an elongated direction of the passage unit 4 and oblique sides of every neighboring actuator units 21 may overlap each other in a widthwise direction, that is, a direction perpendicular to the elongated direction of the passage unit 4. The four actuator units 21 have such a relative positional relationship that they may locate equidistantly on opposite sides of a widthwise center of the passage unit 4.

As illustrated in FIGS. 5 and 6, an under face of the passage unit 4 provides for ink ejection regions where a large number of nozzles 8 are formed in a matrix. A total of ten substantially circular ink receiving ports 5*b* are formed in areas of the top face of the passage unit 4 having no actuator unit 21 bonded thereon (i.e., areas of the top face of the passage unit 4 fixed to the reservoir unit 70). The ink receiving ports 5*b* are opposed to the respective ink discharge ports 74*b* (see FIGS. 3 and 4) of the reservoir unit 70.

The passage unit 4 also includes manifold channels 5 that communicate with the ink receiving ports 5*b*, and sub-manifold channels 5*a* that branch from the corresponding manifold channels 5 (see FIGS. 5 and 6). Similarly with the above-described ink reservoir 73*a*, both the manifold channels 5 and the sub-manifold channels 5*a* extend in the main scanning direction. Each manifold channel 5 has a smaller capacity than that of the ink reservoir 73*a*.

Figure 7:
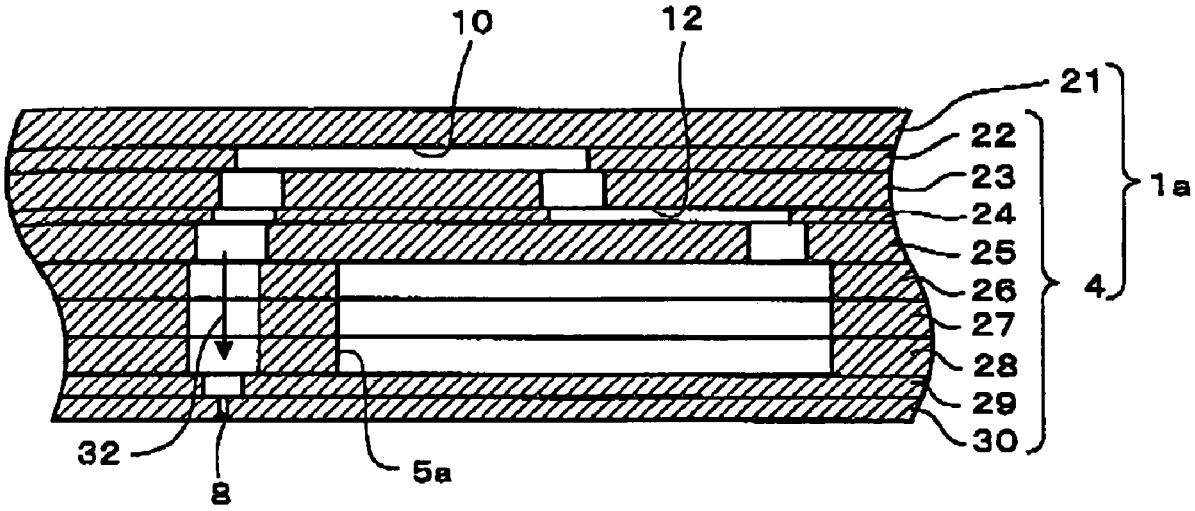
FIG. 7 is a local sectional view taken along a line VII—VII of FIG. 6.

Within the passage unit 4, formed are individual ink passages 32 as shown in FIG. 7, each of which corresponds to each nozzle 8 and extends from the manifold channel 5 to the corresponding nozzle 8 via the sub-manifold channel 5*a* and the pressure chamber 10. That is, ink is introduced from the ink discharge ports 74*b* of the reservoir unit 70 into the ink receiving ports 5*b* of the passage unit 4, and then branches from the manifold channels 5 into the respective sub-manifold channels 5*a*, to reach the tapered nozzles 8 via the apertures 12 and the pressure chambers 10. The aperture 12 functions as a throttle.

As illustrated in FIG. 6, the pressure chambers 10 each having a substantially rhombic shape in a plan view are, similarly to the nozzles 8, arranged in a matrix within the respective ink ejection regions.

Figure 8:
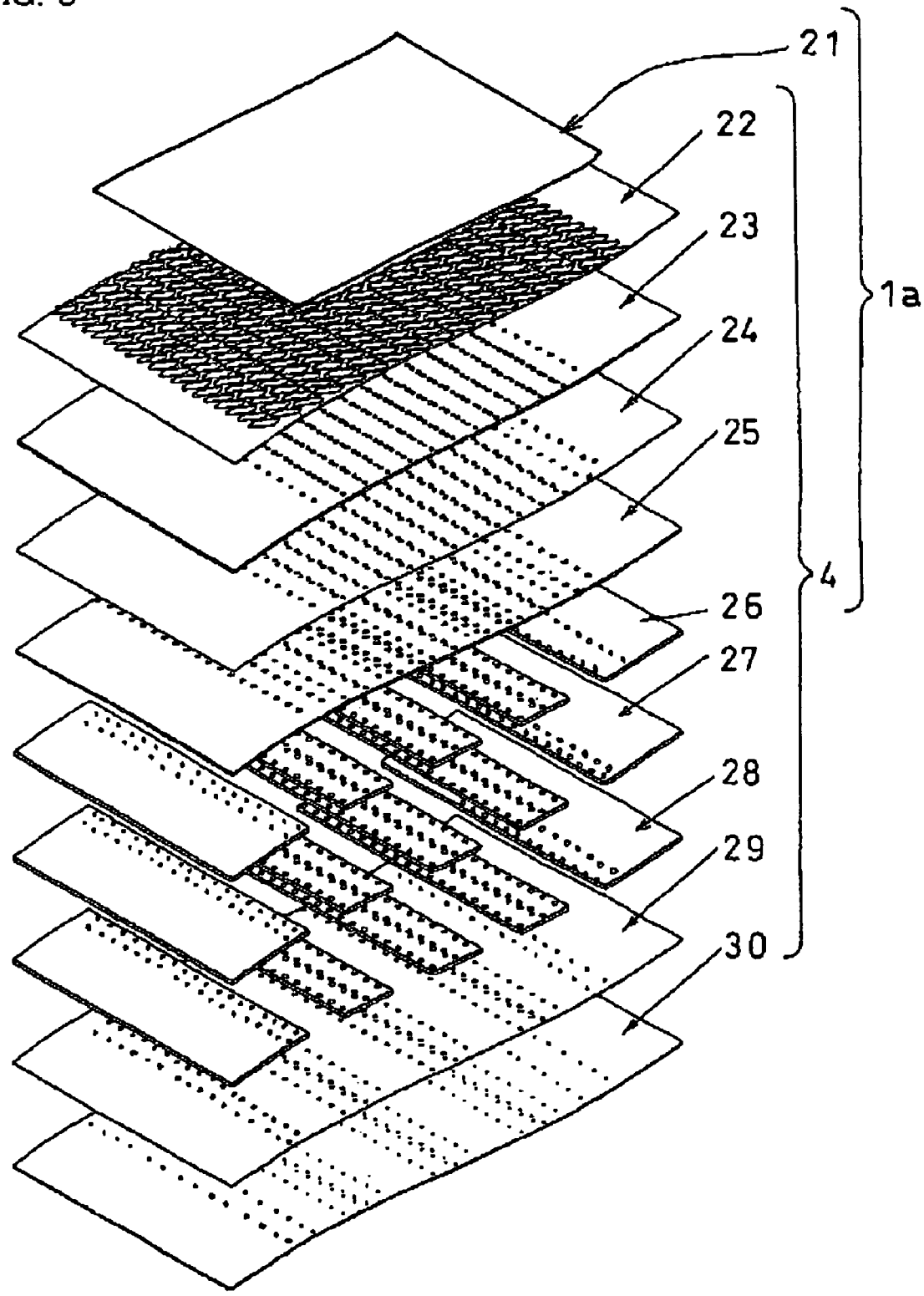
FIG. 8 is a local exploded perspective view of the head main body illustrated in FIG. 1.

Nine metal plates are positioned relative to one another and put in layers so as to form the aforementioned individual ink passages 32, to thereby constitute the passage unit 4 (see FIGS. 7 and 8). More specifically, the passage unit 4 is made up of, from a top side, a cavity plate 22, a base plate 23, an aperture plate 24, a supply plate 25, manifold plates 26, 27, and 28, a cover plate 29, and a nozzle plate 30.

The cavity plate 22 is made of metal, in which formed are a large number of substantially rhombic openings corresponding to the respective pressure chambers 10. The base plate 23 is made of metal, in which formed are communication holes for connecting the respective pressure chambers 10 of the cavity plate 22 with the corresponding apertures 12, and communication holes for connecting the respective pressure chambers 10 with the corresponding nozzles 8. The aperture plate 24 is made of metal, in which formed are not only the apertures 12 but also communication holes for connecting the respective pressure chambers 10 with the corresponding ink nozzles 8. Each aperture 12 is formed of two holes and a half-etched region connecting the two holes. The supply plate 25 is made of metal, in which formed are communication holes for connecting the respective apertures 12 with the corresponding sub-manifold channels 5*a*, and communication holes for connecting the respective pressure chambers 10 with the corresponding ink nozzles 8. The manifold plates 26, 27, and 28 are made of metal, in which formed are not only holes that cooperate with each other to constitute the respective sub-manifold channels 5*a* when these plates are put in layers, but also communication holes for connecting the respective pressure chambers 10 with the corresponding ink nozzles 8. The cover plate 29 is made of metal, in which formed are communication holes for connecting the respective pressure chambers 10 of the cavity plate 22 with the corresponding nozzles 8. The nozzle plate 30 is made of metal, in which formed are the nozzles 8 that correspond to the respective pressure chambers 10 of the cavity plate 22.

Figure 9A:
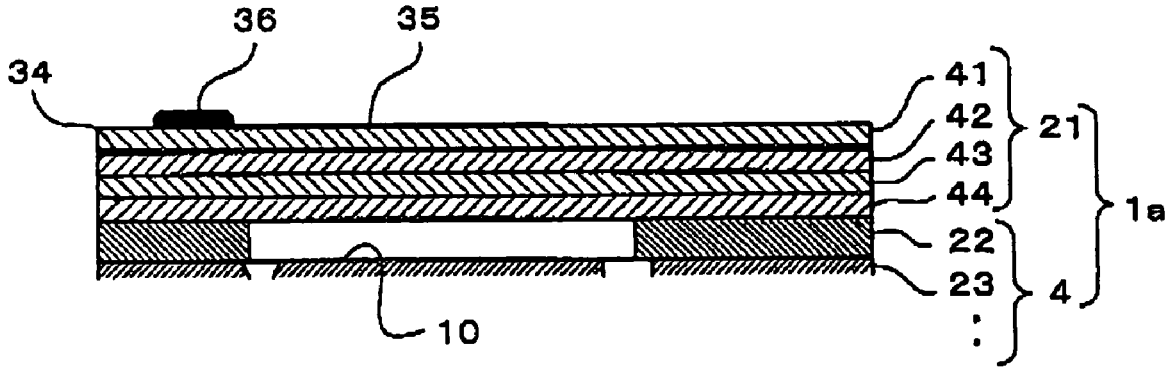
FIG. 9A is a local sectional view of an actuator unit illustrated in FIG. 7.

As illustrated in FIG. 9A, the actuator unit 21 is bonded onto the cavity plate 22 that constitutes the uppermost layer of the passage unit 4. The actuator unit 21 has a layered structure of four piezoelectric sheets 41, 42, 43, and 44 all made of a lead zirconate titanate (PZT)-base ceramic material having ferroelectricity. The four piezoelectric sheets 41 to 44 have the same thickness of approximately 15 μm in the vertical direction, and so disposed as to span the many pressure chambers 10 formed within an ink ejection region.

On the uppermost piezoelectric sheet 41, an individual electrode 35 is provided at a position corresponding to each pressure chamber 10. A common electrode 34 having a thickness of approximately 2 μm in the vertical direction is interposed between the uppermost piezoelectric sheet 41 and the piezoelectric sheet 42 located thereunder. The common electrode 34 is provided throughout entire surfaces of these piezoelectric sheets. Both the individual electrodes 35 and the common electrode 34 are made of, e.g., an Ag—Pd-base metallic material. No electrode is disposed between the piezoelectric sheets 42 and 43, and between the piezoelectric sheets 43 and 44.

Figure 9B:
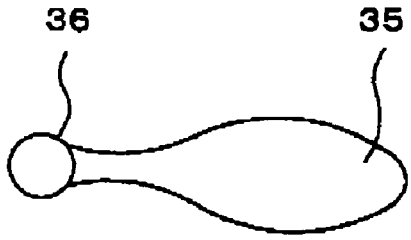
FIG. 9B is a plan view of an individual electrode that is disposed on a surface of the actuator unit in FIG. 9A.

As illustrated in FIG. 9B, the individual electrode 35 with a thickness of approximately 1 μm in the vertical direction has, in a plan view, a substantially rhombic shape similar to the shape of the pressure chamber 10 (see FIG. 6). One acute portion of the substantially rhombic individual electrode 35 is elongated out. This elongation has, on its end, a circular land 36 having a diameter of approximately 160 μm. The land 36 is electrically connected with the individual electrode 35. The land 36 is made of, e.g., gold including glass frits, and bonded onto a surface of the elongation of the individual electrode 35, as illustrated in FIG. 9A. The land 36 is electrically bonded to a contact formed in the FPC 50.

The common electrode 34 is grounded in a non-illustrated region. Thus, the common electrode 34 is kept at the ground potential equally in a region corresponding to any pressure chamber 10. On the other hand, the individual electrodes 35 are connected to the driver IC 83 (see FIG. 2) via the corresponding lands 36 and the FPC 50 that includes different lead wires adapted for the respective individual electrodes 35 in order that the individual electrodes 35 corresponding to the respective pressure chambers 10 can be controlled in their potentials independently of one another.

Since the piezoelectric sheets 41 to 44 span the many pressure chambers 10 as described above, the individual electrodes 35 can be arranged on the piezoelectric sheet 41 at a high density using, e.g., a screen printing technique. Therefore, the pressure chambers 10, which are positioned in correspondence with the individual electrodes 35, can also be arranged in a high density to thereby achieve a high-resolution image printing.

Here will be described how to drive the actuator unit 21.

Within the actuator unit 21, the piezoelectric sheet 41 has been polarized in its thickness direction. In this state, when the individual electrode 35 is set at a different potential from that of the common electrode 34 to thereby apply an electric field to the piezoelectric sheet 41 in the polarization direction, a portion of the piezoelectric sheet 41 having the electric field applied thereto words as an active portion that distorts through a piezoelectric effect. The active portion is, due to transverse piezoelectric effect, going to extend or contract in its thickness direction and contract or extend in its plane direction. On the other hand, the other three piezoelectric sheets 42 to 44 are inactive layers having no region sandwiched between the individual electrode 35 and the common electrode 34, and therefore cannot deform by themselves.

That is, the actuator unit 21 has a so-called unimorph structure in which an upper piezoelectric sheet 41 remote from the pressure chambers 10 constitutes a layer including active portions and the lower three piezoelectric sheets 42 to 44 near the pressure chambers 10 constitute inactive layers.

As illustrated in FIG. 9A, a bottom of the piezoelectric sheets 41 to 44 is fixed onto a top face of the cavity plate 22 in which the pressure chambers 10 are defined. Accordingly, when a difference in distortion in the polarization direction is caused between the portion of the piezoelectric sheet 41 having the electric field applied thereto and the other piezoelectric sheets 42 to 44 located thereunder, the piezoelectric sheets 41 to 44 are as a whole deformed into a convex shape toward the corresponding pressure chamber 10, which is called "unimorph deformation". In association with this deformation, the volume of the pressure chamber 34 decreases and thus pressure of ink rises, so that the ink is ejected from the corresponding nozzle 8.

Then, when the individual electrode 35 is returned to the same potential as that of the common electrode 34, the piezoelectric sheets 41 to 44 restore their original flat shape, and thus the pressure chamber 10 also restores its original volume. Ink is accordingly introduced from the manifold channel 5 into the pressure chamber 10, which therefore stores the ink again.

According to the ink-jet head 1 of this embodiment, as described above, the inflow port 72*d* is so formed in the reservoir unit 70 as to correspond to the center of the ink reservoir 73*a*, and at the same time the inflow port 72*d* is disposed such that there can exist the same number (five in this embodiment) of outflow ports 74*c* on either side of the inflow port 72*d* in the extending direction of the ink reservoir 73*a*. This configuration can relatively reduce differences in distance between the inflow port 72*d* and the respective outflow ports 74*c*. Accordingly, ink that has passed through the outflow ports 74*c* nearer to the inflow port 72*d* and the corresponding ink discharge ports 74*b* to thereby reach the manifold channel 5 can be prevented from flowing back through the outflow ports 74*c* remote from the inflow port 72*d* into the ink reservoir 73*a* again prior to ink reaching the outflow ports 74*c* remote from the inflow port 72*d*. This can relieve a problem of air stay within the ink reservoir 73*a* and the like, so that ink can smoothly be supplied to the respective pressure chambers 10.

Moreover, in a plan view, the ink reservoir 73*a* tapers toward its lengthwise ends, and the outflow ports 74*c* are disposed at positions corresponding to the both lengthwise ends of the ink reservoir 73*a*. Due to this configuration, ink can flow at a higher speed when it travels toward the outflow ports 74*c* disposed at the both lengthwise ends of the ink reservoir 73*a*, i.e., toward the outflow ports 74*c* relatively remote from the inflow port 72*d*. Therefore, ink can soon reach the outflow ports 74*c* that are relatively remote from the inflow port 72*d*. This can enhance the foregoing effects, i.e., the effects of prevention of air stay within the ink reservoir 73*a* and smooth ink supply to the respective pressure chambers 10.

Further, the ink reservoir 73*a* has a planar shape of point-symmetrical with respect to its center, and the outflow ports 74*c* are also arranged point-symmetrically with respect to the center of the ink reservoir 73*a*. Consequently, ink that has flown through the inflow port 72*d* into the ink reservoir 73*a* can be dispersed efficiently and travels toward the respective outflow ports 74*c*. This can furthermore enhance the effects of prevention of air stay within the ink reservoir 73*a* and smooth ink supply to the respective pressure chambers 10.

As illustrated in FIGS. 3 and 4, the ink introduction port 71*b* is further from the center of the ink reservoir 73*a* than the inflow port 72*d* is. This can realize an effective use of a space above the reservoir unit 70, on which for example the main substrate 82 and the sub substrates 71 can be disposed.

When, as in this embodiment, the filter 70*f* is disposed in the introduction passage, and more specifically disposed on the step formed at the boundary between the first depression 72*a* and the second depression 72*b*, an area of the filter 70*f* can become larger as compared with a filter that is to be disposed on each of the outflow ports 74*c*. As a result, a passage resistance decreases, and therefore ink can smoothly be supplied to the respective pressure chambers 10.

The ink reservoir 73*a* comprises the main passage 73*c*, and the branch passages 73*b* branching from the main passage 73*c* and each having a narrower width than that of the main passage 73*c*. The inflow port 72*d* is disposed in confrontation with the main passage 73*c*, and the outflow ports 74*c* are disposed in confrontation with the respective branch passages 73*b*. Since the ink reservoir 73*a* is thus formed in conformity with flow of ink toward the respective outflow ports 74*c*, the passage resistance within the ink reservoir 73*a* can be decreased and therefore ink can smoothly be supplied to the respective pressure chambers 10.

Alternatively, the inflow port 72*d* and the outflow ports 74*c* can be disposed in confrontation with the branch passages 73*d* and the main passage 73*c*, respectively. In this case, within the ink reservoir 73*a*, ink flows from the branch passages 73*b* to the main passage 73*c*.

It is not always required that the ink reservoir 73*a* comprises the above-described main passage 73*c* and branch passages 73*b*. For example, a branch passage that branches from a main passage may have substantially the same width as that of the main passage, or alternatively larger width as that of the main passage.

The planar shape of the ink reservoir 73*a* is not limited to the one tapering toward its lengthwise ends in a plan view, but it can variously be changed. The planar shape of the ink reservoir 73*a* may taper toward only one lengthwise end thereof or may not have the tapered shape.

The planar shape of the ink reservoir 73*a* and the arrangement of the outflow ports 74*c* may not necessarily be point-symmetrical with respect to the center of the ink reservoir 73*a*, but they may be line-symmetrical. Alternatively, they may neither be point-symmetrical nor line-symmetrical.

The outflow ports 74*c* can be disposed not at both lengthwise ends of the ink reservoir 73*a*, but other various positions such as one lengthwise end alone of the ink reservoir 73*a* and portions other than the ends of the ink reservoir 73*a*, etc.

It is not limitative that the inflow port 72*d* is nearer to the center of the ink reservoir 73*a* than the ink introduction port 71*b* is. For example, the inflow port 72*d* may be disposed at a position slightly out of the center of the ink reservoir 73*a* with the ink introduction port 71*b* being disposed at the center of the ink reservoir 73*a*.

The inflow port 72*d* may not be disposed corresponding to the center of the ink reservoir 73*a*, and moreover may not be disposed such that there can exist the same number of outflow ports 74*c* on either side of the inflow port 72*d*. For example, the inflow port 72*d* can be disposed such that numerical difference of the existing outflow ports 74*c* is one on either side of the inflow port 72*d*.

The inflow port 72*d* may be disposed at other various positions as long as at least one outflow port 74*c* exists on either side of the inflow port 72*d* in the extending direction of the ink reservoir 73*a*.

Although the filter 70*f* is disposed within the introduction passage in the above-described embodiment, the filter may be disposed at any other positions within the reservoir unit 70, or the filter can be omitted.

An application of the present invention is not limited to ink-jet printers. The present invention is applicable also to, for example, ink-jet type facsimile or copying machines.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet head comprising:

a passage unit that includes a common ink chamber extending in one direction and a plurality of individual ink passages each extending from the common ink chamber through a pressure chamber to a nozzle; and a reservoir unit fixed to the passage unit and including an ink reservoir that stores ink, the ink reservoir extending in the one direction and having a larger capacity than that of the common ink chamber, wherein the reservoir unit includes:

an ink introduction port into which ink is introduced;

an introduction passage that extends from the ink introduction port to the ink reservoir and that includes an inflow port facing the ink reservoir;

a plurality of ink discharge ports through which ink is discharged into the common ink chamber; and a plurality of discharge passages that extend from the ink reservoir to the ink discharge ports and that include a plurality of outflow ports facing the ink reservoir, and wherein the inflow port is disposed such that at least one outflow port can exist on either side of the inflow port with respect to the one direction.

2. The ink-jet head according to claim 1, wherein the inflow port is disposed at a position corresponding to a center of the ink reservoir with respect to the one direction.

3. The ink-jet head according to claim 1, wherein the inflow port is disposed at any one of: such a position that the same number of outflow ports can exist on either side of the inflow port with respect to the one direction; and such a position that numerical difference of the existing outflow ports is one on either side of the inflow port with respect to the one direction.

4. The ink-jet head according to claim 1, wherein:

the ink reservoir has a planar shape that tapers toward its end in the one direction; and one of the outflow ports is disposed at a position corresponding to the end of the ink reservoir in the one direction.

5. The ink-jet head according to claim 1, wherein:

the ink reservoir has any one of line-symmetrical and point-symmetrical planar shapes with respect to a center of the ink reservoir in the one direction; and the plurality of outflow ports are arranged in any one of line-symmetrical and point-symmetrical manners with respect to the center of the ink reservoir in the one direction.

6. The ink-jet head according to claim 1, wherein the ink introduction port is disposed further from a center of the ink reservoir with respect to the one direction than the inflow port is.

7. The ink-jet head according to claim 1, wherein a filter is disposed in the introduction passage.

8. The ink-jet head according to claim 1, wherein:

the ink reservoir has a main passage that extends in the one direction, and a branch passage that branches from the main passage and has a narrower width than that of the main passage;

the inflow port is disposed in confrontation with the main passage; and the outflow ports are disposed in confrontation with the branch passage.

9. A reservoir unit fixed to a passage unit in an ink-jet head, the passage unit having a common ink chamber extending in one direction and a plurality of individual ink passages each extending from the common ink chamber through a pressure chamber to a nozzle, the reservoir unit comprising:

an ink reservoir for storing ink, the ink reservoir extending in the one direction, having a larger capacity than that of the common ink chamber, and being in fluid communication with the common ink chamber;

an inflow port through which the ink reservoir is in fluid communication with an outside of the reservoir; and a plurality of outflow ports through which the ink reservoir is in fluid communication with the common ink chamber, wherein the inflow port is disposed such that at least one outflow port can exist on either side of the inflow port with respect to the one direction.

10. The reservoir unit according to claim 9, wherein the inflow port is disposed at a position corresponding to a center of the ink reservoir with respect to the one direction.

11. The reservoir unit according to claim 9, wherein the inflow port is disposed at such a position that the same number of the outflow ports can exist on either side of the inflow port with respect to the one direction.

12. The reservoir unit according to claim 9, wherein:

the ink reservoir has a planar shape that tapers toward its end in the one direction; and one of the outflow ports is disposed at a position corresponding to the end of the ink reservoir in the one direction.

13. The reservoir unit according to claim 9, wherein:

the ink reservoir has any one of line-symmetrical and point-symmetrical planar shapes with respect to a center of the ink reservoir in the one direction; and the plurality of outflow ports are arranged in any one of line-symmetrical and point-symmetrical manners with respect to the center of the ink reservoir in the one direction.

14. The reservoir unit according to claim 9, wherein:

the ink reservoir has a main passage that extends in the one direction, and a branch passage that branches from the main passage and has a narrower width than that of the main passage;

the inflow port is disposed in confrontation with the main passage; and the outflow ports are disposed in confrontation with the branch passage.

* * * * *